US009433838B2

(12) United States Patent
Stout

(10) Patent No.: US 9,433,838 B2
(45) Date of Patent: Sep. 6, 2016

(54) SHOE HOLDER ARRANGED FOR ATTACHMENT TO A GOLF BAG

(71) Applicant: Stout Products, LLC, Chalfont, PA (US)

(72) Inventor: Jason Stout, Chalfont, PA (US)

(73) Assignee: Stout Products, LLC, Chalfont, PA (US)

( * ) Notice: Subject to any disclaimer, the term of this patent is extended or adjusted under 35 U.S.C. 154(b) by 199 days.

(21) Appl. No.: 14/509,413

(22) Filed: Oct. 8, 2014

(65) Prior Publication Data

US 2016/0101332 A1 Apr. 14, 2016

(51) Int. Cl.
*A63B 57/00* (2015.01)
*A63B 55/00* (2015.01)

(52) U.S. Cl.
CPC ..... *A63B 57/00* (2013.01); *A63B 55/00* (2013.01)

(58) Field of Classification Search
CPC ..... A63B 57/00; A63B 55/00
See application file for complete search history.

(56) References Cited

U.S. PATENT DOCUMENTS 1,030,940 A * 7/1912 Subberg ..... A47F 7/08 190/13 F
1,447,636 A * 3/1923 White ..... A47G 25/08 211/35
1,685,277 A * 9/1928 Dryden ..... A47G 25/005 211/106
1,909,942 A * 5/1933 Fingerman ..... A45C 3/12 206/278
3,635,353 A * 1/1972 Matsubara ..... B65D 73/0042 211/34
4,083,483 A 4/1978 Bayless
4,383,563 A 5/1983 Kirchhoff
4,702,016 A * 10/1987 Grigsby ..... F26B 11/0463 211/35
4,767,001 A 8/1988 Kim
4,869,365 A * 9/1989 Perdue ..... A63B 55/408 206/315.5
4,967,913 A * 11/1990 Bayer ..... A47F 5/0006 211/118
5,096,059 A * 3/1992 Henderson ..... A63B 55/408 206/315.3
5,199,581 A 4/1993 Arnold
5,282,553 A 2/1994 Ibled
5,402,883 A 4/1995 Shin
5,623,769 A * 4/1997 Hayden ..... D06F 58/04 248/206.5
5,810,064 A 9/1998 Sanderson
5,918,357 A 7/1999 Pennell
5,927,361 A 7/1999 Sanderson
5,950,824 A 9/1999 Millar
6,330,994 B1 12/2001 Elio
6,374,509 B1 4/2002 Jackson et al.
6,557,702 B1 5/2003 Sanderson et al.
6,612,412 B2 9/2003 Sanderson
7,077,252 B2 7/2006 Sanchez
7,159,877 B2 1/2007 So
8,011,484 B2 * 9/2011 McIntyre ..... A45C 5/04 190/110
8,640,866 B1 * 2/2014 Dow ..... A63B 55/10 206/315.1
8,720,758 B2 5/2014 Angeli et al.
2007/0045992 A1 3/2007 Jackson
2008/0035691 A1 2/2008 Losos
2010/0193451 A1 8/2010 Levine
2014/0187342 A1 7/2014 Brady

* cited by examiner (Continued)

*Primary Examiner* — Tri Mai
(74) *Attorney, Agent, or Firm* — Caesar Rivise, PC

(57) ABSTRACT

A shoe holder is arranged for attachment to a golf bag. The shoe holder includes a basket in which a pair of shoes may be retained. The basket includes a cavity that is arranged for accepting the toe-portion of the shoes. An elongate central member extends upwardly from the basket to an upper end. A pair of elastically-deformable spring clips extends from the upper end of the elongate central member and is arranged to engage the rim of the golf bag to secure the shoe holder to the golf bag. A retention strap attached to the elongated central member is configured to extend across the shoes and retain them against the elongated central member.

7 Claims, 3 Drawing Sheets

70
77
72
75
20
82
28
66
86
46
24
50
30
42
54
62
34
50
73
46
38

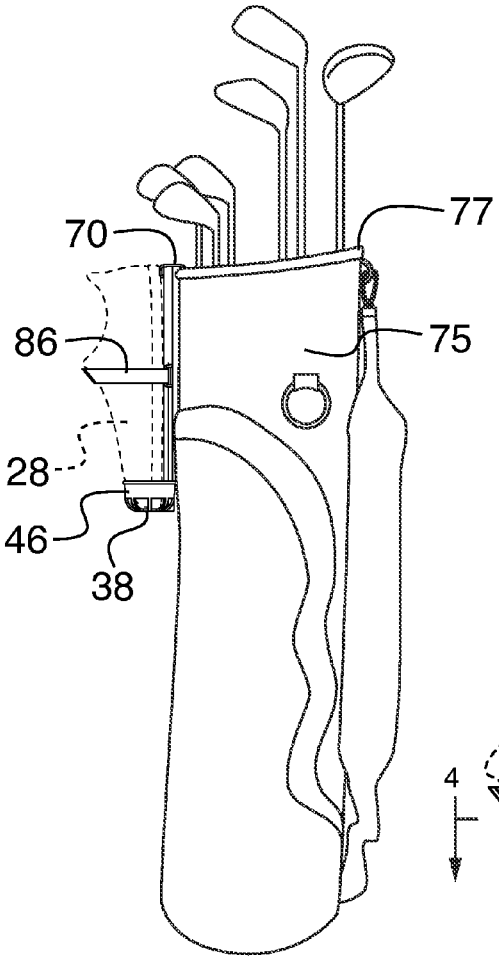
FIG. 2
FIG. 3
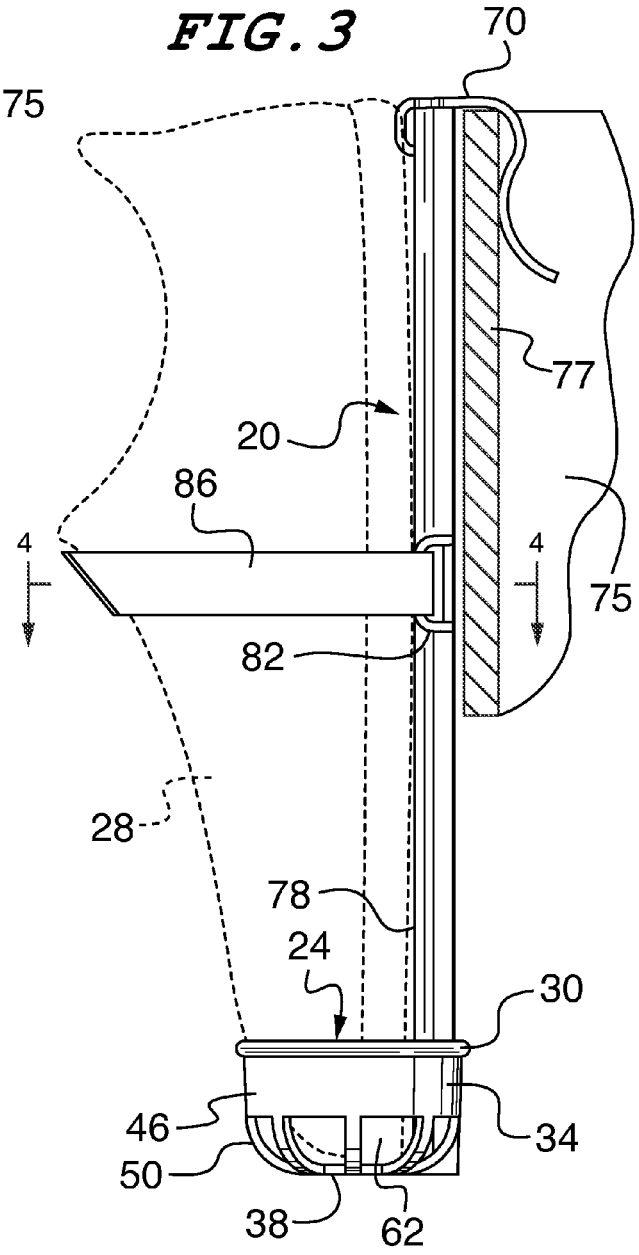

SHOE HOLDER ARRANGED FOR ATTACHMENT TO A GOLF BAG

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates to a holder for shoes, such as golf shoes or street shoes. More specifically, the invention relates to a shoe holder that is arranged to be attached to and rest against the outside surface of a golf bag to enable the user to see his or her golf shoes during storage to prevent golf shoes from being forgotten when preparing for a golf outing.

BACKGROUND OF THE INVENTION

Many golfers wear special shoes with spikes attached to the soles when playing golf at public or private-membership golf courses. These golf shoes can be made of metal or plastic (plastic spikes are also known as "soft spikes") designed to increase traction thus helping the player to keep his/her balance during the swing, on greens, or in wet conditions. Most golf shoes are intended for wearing on golf courses and are not intended to be worn as a general purpose shoe. Therefore, golf shoes must be carried, not worn, to the golf course. Oftentimes, when gathering equipment needed for a golf outing, golf shoes are forgotten. Golfers frequently do not realize they have forgotten their golf shoes until they have already left home and arrived at the golf course. Often, returning home to retrieve the golf shoes will result in delays for other golfers in the group who are required to tee off at the same time. The other golfers in the group may be invited business guests, making any delay not a reasonable option. Faced with such circumstances, a golfer who has forgotten his or her golf shoes may feel compelled to purchase another pair at a pro shop located on the golf course facility, or at a neighboring sporting goods store located in proximity to the golf course. When in these circumstances, because the golfer is under the pressure of time, he or she may spend more on golf shoes that are less well suited for him or her.

Many existing golf bags do include compartments for storage of golf shoes. However, these compartments are usually opaque, and thus, the golfer is unable to determine whether golf shoes have been stored within the compartment, unless the golfer opens the compartment and checks. Often, when gathering golf equipment needed for a golf outing, this compartment is empty and goes unchecked until the golfer has reached the golf course and realizes the golf shoes have been forgotten.

The present invention addresses the foregoing problem by providing a shoe holder that is arranged to attach to a golf bag and rests against the outside surface of the bag, thus making the golf shoes visible during their storage and when gathering equipment for a golf outing. In this manner, the shoe holder of the present invention will reduce the possibility of forgotten or misplaced golf shoes, as discussed above. Also, the shoe holder of the present invention enables the golfer to store his or her street shoes in the holder while wearing golf shoes during golf play to reduce the possibility of forgotten or misplaced street shoes. The present invention is an affordable and functional addition for golfers, both recreational and professional.

SUMMARY OF THE INVENTION

A shoe holder is arranged for attachment to a golf bag. The shoe holder includes a basket in which a pair of shoes may be retained. The basket includes a cavity that is arranged for accepting the toe-portion of the shoes. An elongate central member extends upwardly from the basket to an upper end. A pair of elastically-deformable spring clips extends from the upper end of the elongate central member and is arranged to engage the rim of the golf bag to secure the shoe holder to the golf bag. A retention strap attached to the elongated central member is configured to extend across the shoes and retain them against the elongated central member.

DESCRIPTION OF THE DRAWINGS

FIG. 2 is a side elevational view of the shoe holder of the present invention shown holding a pair of shoes and being attached to a golf bag;

FIG. 3 is an enlarged side elevational view of the shoe holder of the present invention shown holding a pair of shoes and being attached to a golf bag; and, FIG. 4 is an enlarged top view of the shoe holder of the present invention shown holding a pair of shoes.

DETAILED DESCRIPTION OF THE PREFERRED EMBODIMENT

Figure 1:
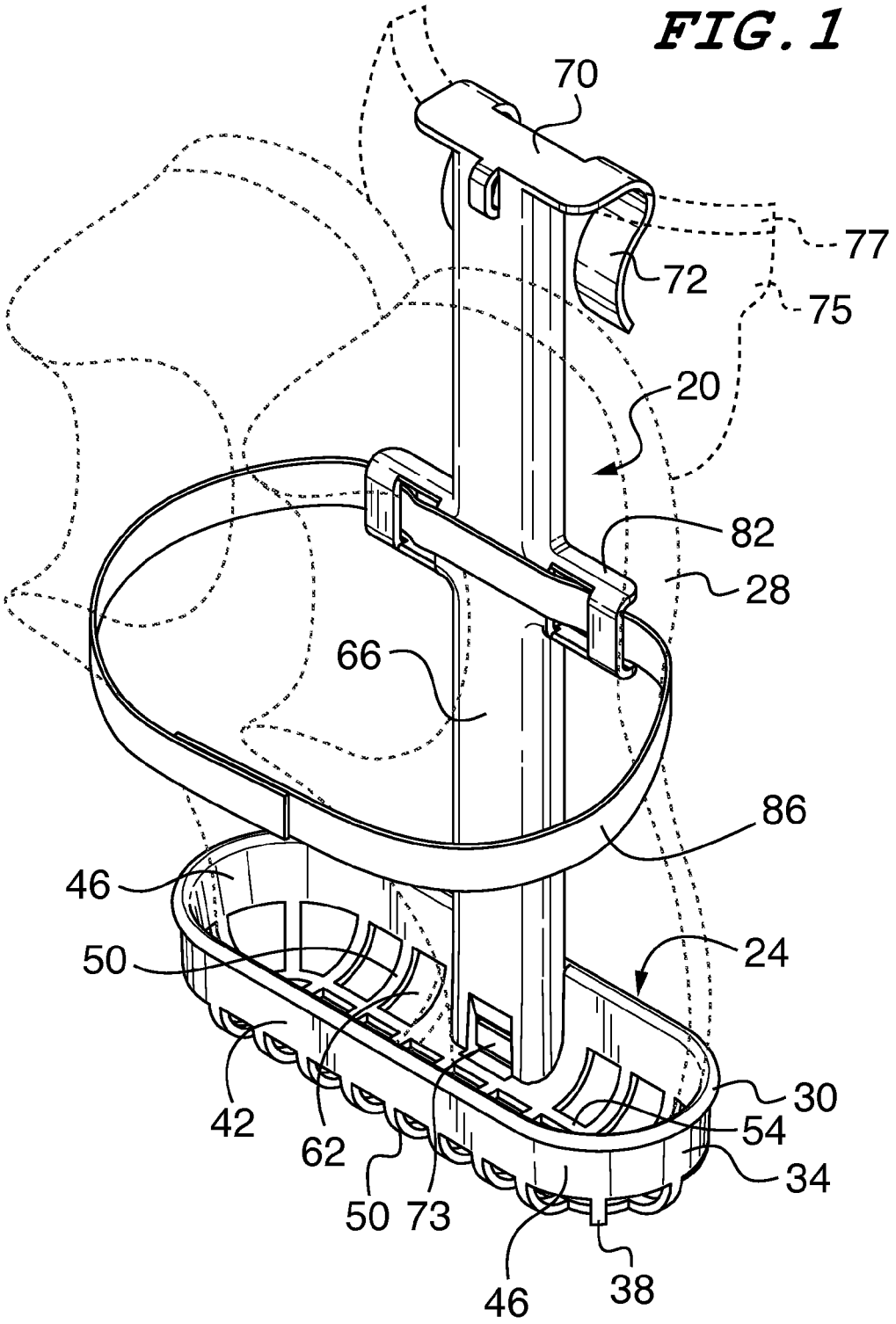
FIG. 1 is an isometric view of the shoe holder of the present invention shown holding a pair of shoes and being attached to a golf bag.
Figure 4:
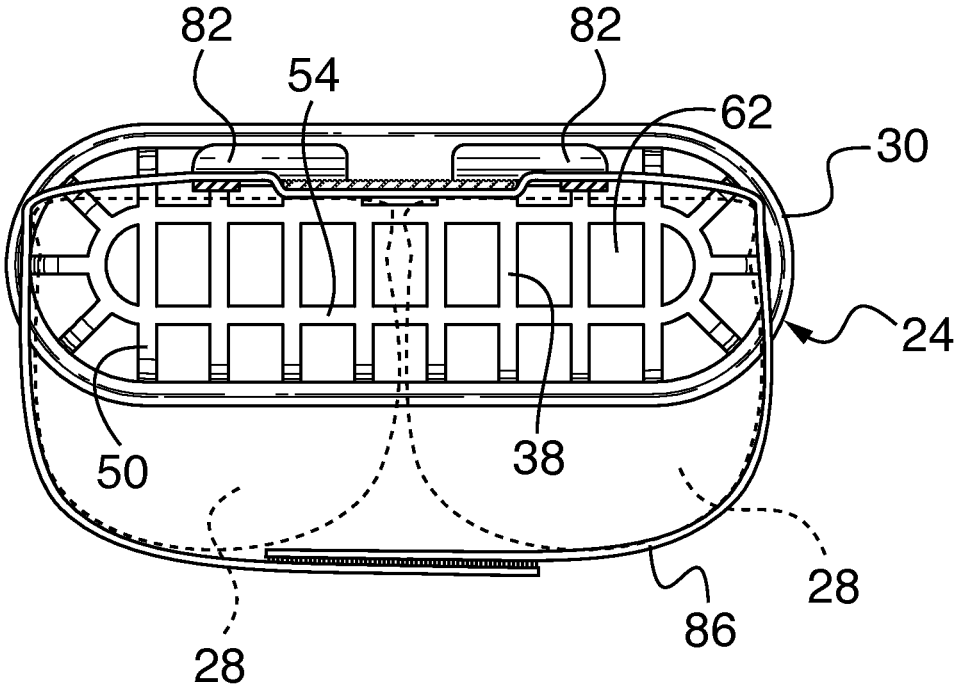

Referring now in greater detail to the drawings in which like numerals represent like components throughout the several views, there is shown in FIGS. 1-4 an embodiment of the shoe holder of the present invention which is broadly designated by the numeral 20. As best shown in the figures, the shoe holder 20 is shown attached to the outer surface of a golf bag 75 having a reinforcement rim 77. The shoe holder 20 includes several features discussed below. The shoe holder 20 includes a basket 24 for retaining a pair of shoes 28. The basket 24 is elongated in shape and includes an open top rim 30, a substantially vertical sidewall 34 extending downwardly from the top rim 30, and a floor 38. As best shown in FIG. 1, the top rim 30 and sidewall 34 form an enclosure that includes parallel straight portions 42 that are joined to or are integral with opposed end portions 46 that are roughly semi-circular in shape. A plurality of spaced-apart ribs 50 extend downwardly from the sidewall 34 and curve at an approximately 90 degree angle to join with another plurality of spaced-apart ribs 54. Together the ribs 50 and 54 interconnect with each other to form the floor 38 of integral construction. The ribs 50 and 54 define drainage openings 62 therebetween. The drainage openings 62 are sized to confine the pair of shoes 28 within the basket 24, and allow moisture and debris to drain and fall from the shoes 28 after use when the shoes are stored within the holder 20.

An elongate central member 66 is attached at its lower end to the basket 24 and extends upwardly to an upper end where the central member 66 is attached to a clip assembly 70 comprising a pair of spring clips 72. At its lower end, the elongate central member 66 may be attached to the basket 24 by any suitable means, e.g., a snap-fit connector 73 including a male portion formed on the central member 66 that is arranged to be snap-fitted into a female receptacle formed on the basket 24. Alternatively, the central member 66 may be integral with the basket 24, or the central member 66 may be attached to the basket 24 in other conventional ways.

The spring clip assembly 70 including the spring clips 72 may be formed of any suitable sheet material folded to a desired configuration, as shown in the figures. The figures illustrate the preferred embodiment wherein two spring clips 72 are spring biased to a closed position. The spring clips 72 are arranged to extend over the reinforcement rib 77 of the golf bag 75 and extend into any one of the individual club holes (not shown) within the golf bag 75, the club holes otherwise being provided for retaining the shaft of each individual golf club. Once frictionally secured, the shoe holder 20 of the present invention is disposed on the outside surface of the golf bag 75.

A cross bar 82 is located approximately mid-way up the height of the central member 66, and includes openings through which a retention strap 86 may be threaded. The retention strap 86 is arranged to wrap around the shoes 28 disposed within the basket 24 and retain them therein against the central member 66. The free ends of the retention strap 86 include a VELCRO® (hook or loop) surface or equivalent fastening means adapted to secure the strap 86 over the shoes 28. All parts of the above described embodiments may be made of plastic and/or metal.

It is understood that the shoe holder arranged for attachment to a golf bag of the present invention and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

I claim:

1. A shoe holder arranged for attachment to a golf bag, the top end of the bag usually furnished with a substantial reinforcing rim, said shoe holder comprising:

a. a basket for retaining a pair of shoes, said basket comprising walls and a floor to define a basket cavity, said basket cavity formed of a plurality of interconnected ribs to form a one-piece open-frame construction including openings, said basket arranged for accepting the toe-portion of a pair of shoes and the openings being sized to confine the shoes within the basket;

b. an elongate central member having a lower end and extending upwardly from said basket to an upper end;

c. a plurality of spring clips extending from the upper end of said elongate central member, said plurality of spring clips being elastically deformable and arranged for extending over the reinforcement rim of the golf bag and securing said shoe holder to the golf bag; and, d. a retention strap carried by said elongated central member and configured to wrap around the shoes and retain them against the elongated central member.

2. The shoe holder of claim 1, wherein said elongate central member is detachably connected to said basket.

3. The shoe holder of claim 1, wherein said elongate central member is removeably clipped to said basket.

4. The shoe holder of claim 1, additionally comprising a cross bar located approximately mid-way up the height of said elongate central member, said cross bar including openings through which said retention strap is threaded.

5. The shoe holder of claim 1, wherein said basket is in the shape of an elongated trough.

6. The shoe holder of claim 1, wherein said retention strap includes free ends and hook and loop surfaces located at said free ends.

7. The shoe holder of claim 1, wherein said plurality of spring clips includes a pair of spring clips.

* * * * *